United States Patent [19]

Grynaeus et al.

[11] Patent Number: 5,063,101

[45] Date of Patent: Nov. 5, 1991

[54] INTERLINING

[75] Inventors: Peter S. Grynaeus, Lowell; Anthony Hollingsworth, Pepperel; Chester J. Petkiewicz, Lowell, all of Mass.

[73] Assignee: Freudenberg Nonwovens Limited Partnership, Lowell, Mass.

[21] Appl. No.: 289,611

[22] Filed: Dec. 23, 1988

[51] Int. Cl.[5] ..... A41D 27/00; A41D 27/06; B32B 3/10; B32B 7/14

[52] U.S. Cl. ..... 428/172; 2/97; 2/255; 2/272; 428/196; 428/200; 428/246; 428/248; 428/257; 428/286; 428/340; 428/349; 428/354

[58] Field of Search ..... 428/172, 200, 286, 349, 428/354, 196, 246, 248, 257, 340; 2/97, 255, 272

[56] References Cited

U.S. PATENT DOCUMENTS

| | | | |
|---|---|---|---|
| 3,333,280 | 8/1967 | Hynek et al. . | |
| 3,511,747 | 5/1970 | Davies . | |
| 3,837,995 | 9/1974 | Fladen . | |
| 4,143,424 | 3/1979 | Knoke et al. . | |
| 4,148,958 | 4/1979 | Tischer et al. | 428/200 |
| 4,373,000 | 2/1983 | Knoke et al. . | |
| 4,418,116 | 11/1983 | Scott . | |
| 4,450,196 | 5/1984 | Kamat | 428/197 |
| 4,451,520 | 5/1984 | Tecl et al. . | |
| 4,465,723 | 8/1984 | Knoke et al. | 428/200 |
| 4,477,516 | 10/1984 | Sugihara et al. . | |
| 4,479,999 | 10/1984 | Buckley et al. . | |
| 4,500,384 | 2/1985 | Tomioka et al. . | |
| 4,542,060 | 9/1985 | Yoshida et al. . | |
| 4,613,538 | 9/1986 | Wendell et al. | 428/200 |
| 4,623,575 | 11/1986 | Brooks et al. . | |
| 4,632,858 | 12/1986 | Knoke et al. . | |
| 4,632,861 | 12/1986 | Vassilatos . | |
| 4,647,492 | 3/1987 | Grant et al. . | |
| 4,657,804 | 4/1987 | Mays et al. . | |
| 4,684,570 | 8/1987 | Malaney . | |
| 4,731,274 | 3/1988 | Ishida et al. | 428/200 |
| 4,737,396 | 4/1988 | Kamat | 428/198 |

FOREIGN PATENT DOCUMENTS

| | | |
|---|---|---|
| 0049732 | 4/1982 | European Pat. Off. . |
| 2322734 | 4/1977 | France . |
| 2330341 | 6/1977 | France . |
| 2122109 | 1/1984 | United Kingdom . |

*Primary Examiner*—James C. Cannon
*Attorney, Agent, or Firm*—Felfe & Lynch

[57] ABSTRACT

Disclosed is a textile product and a method for making that product for a shirt or blouse interlining formed of a bonded base material having bonded thereon a fleece of adhesive fibers. A plurality of adhesive dots are applied on that surface of the fleece opposite to the surface bonded to the base material. The dots are substantially in a singular planar arrangement and, at least some of the dots, are separated from the base material by the fleece. The interlining can be fused to a shirt fabric such, as a broadcloth, to provide a good and smooth surface appearance. With the product of the invention, the smooth surface appearance is retained even after washing.

43 Claims, 1 Drawing Sheet

INTERLINING

The present invention is in a garment interlining and a method for producing the same. More specifically the present invention is in an interlining for shirts, blouses and the like and are especially useful for shirt or blouse collars, cuffs and pocket flaps. Interlinings are fabric composites used to impart certain properties to particular areas of garments.

For garments such as shirts, an interlining should have certain desirable properties. The interlining, when bonded to the shirt or blouse material should provide some degree of stiffness but the garment should retain its handling characteristics. The interlining should also have good shape retention, especially after washing or dry cleaning and should, when fused to the garment material give a smooth surface appearance. It is thus necessary that the interlining have a good and uniform adhesion to the outer fabric.

For shirts, the interlinings are formed of a base material, such as a nonwoven material with a point bonding pattern, the upper surface of which has a number of adhesive dots. At least one of the surfaces of the base material is contoured or textured. The contoured surface includes depressions or pits and plateaus. These adhesive dots are on one of the contoured surfaces of the base material, including in the pits between adjacent plateaus, the plateaus and connecting borders.

However, it has been found that such interlinings are unsuitable because they often cause a streaking, i.e., an uneven outer surface appearance, in the completed garment. Due to the contoured arrangement of adhesive dots, a garment material or outer fabric fused to the base material will also acquire a corresponding contour. This contour is visible by the appearance of streaks in the finished outer surface of the garment. This problem becomes aggravated after washing, especially with heavier base materials, because the structure loosens up and can result in areas of the garment having a "puffed" appearance, thus emphasizing any such streaks.

SUMMARY OF THE INVENTION

The present invention avoids the above-described undesirable interlining characteristics and provides an interlining, which when fused to an outer fabric, gives a good surface smoothness and does not exhibit streakiness and retains its good appearance even after repeated washings.

The present invention is in a textile product for a shirt or blouse interlining formed of a bonded base material, preferably a point bonded nonwoven fabric, having bonded thereon a layer or a fleece containing adhesive fibers. A plurality of adhesive dots are applied on that surface of the fleece opposite to the surface bonded to the base material. The adhesive dots are substantially in a singular planar arrangement and, at least some of the dots, and preferably a majority of the dots, are separated from the base material by the fleece or layer. The interlining can be fused to a shirt fabric, such as a broadcloth or a variety of batistes, to provide a good and smooth surface appearance. With the product of the invention, the smooth surface appearance is retained even after washing.

The present invention is also in a method for producing the above-described interlining and product. In the method of the invention, a base material is provided, a layer or a fleece layer of adhesive fibers is deposited on a surface of the base material and bonded thereto. The adhesive dots are then applied to the bonded product on top of the fleece in a known manner.

While it is preferred that the base material be a nonwoven fabric which is point bonded, a suitable base material may also be produced by a water entanglement process. Also, the layer may be deposited on the surface of the base material as an extruded porous film. It is also possible to produce the base material by a combination of point bonding and ultrasonic techniques.

In a further aspect of the invention, the interlining is bonded to an outer fabric to provide a garment.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figure 1:
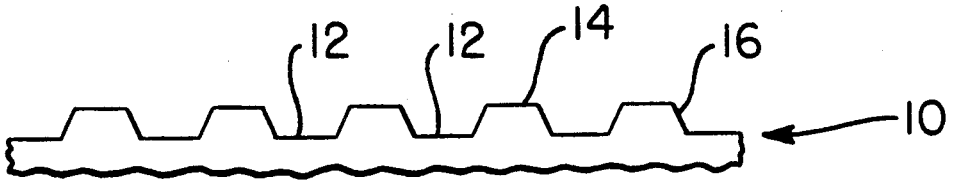
FIG. 1 shows a base material useful in the invention.

FIG. 1 shows an upper section of a point bonded or textured nonwoven base material 10. The base material has a textured surface dependent upon the engraving of the point bonding pattern or other means of manufacturing such as water entanglement. The contoured or textured surface has spaced depressions or pits 12 separated by plateaus 14. Sloping walls or borders 16 extend from depressions 12 to the plateaus 14. The base material lower surface (not shown) may have a similar contour or texture.

The base material must be contoured or textured to obtain a textile handle in contrast to a paper-like feel. Preferably the base material is point bonded. Point bonding can be achieved by an engraved or gravured heated calender roller or ultrasonic bonding. Textured surfaces can be obtained by water entanglement, mechanical entanglement such as needling, or other techniques.

The base material 10 is of polyester. While the base material is preferably 100% polyester, it may contain up to about 90 wt.-% of one or more co-fibers such as rayon, Nylon 6, Nylon 6,6 and cotton. When the base material is of 100% polyester, it may optionally contain up to about 90 wt.-% of a copolyester, either as a homofil or heterofil.

When the base material is produced by water entanglement, it may contain up to 100 wt.-% of one or more cofibers such as rayon, Nylon 6, Nylon 6,6 and cotton. When the base material is of 100% polyester, it may optionally contain 100 wt.-% of a copolyester, either as a homofil or heterofil.

A highly preferred polyester is a polyethyleneterephthalate (PET), especially when the base material is 100% polyester. When the base material contains a heterofil, the second component can be a polybutyleneterephthalate (PBT). A 50% PET-PBT blend is especially preferred.

The base material should have a specific weight of at least 25 g/m$^2$. Suitable nonwoven base materials are commercially available as from Freudenberg Nonwovens USA. A typical nonwoven base material has a thickness of approximately 13 mils. The combined depressions 12 are generally about 8 to 12 mils in depth.

Figure 2:
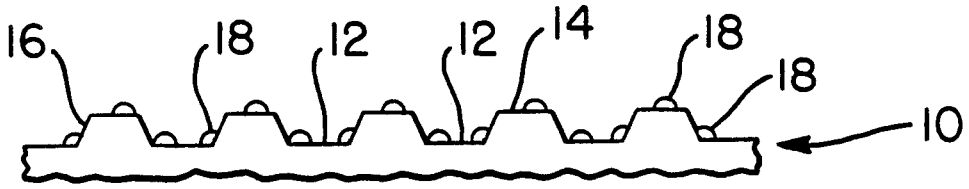
FIG. 2 shows a prior art construction.

FIG. 2 shows a prior art construction with adhesive dots 18 printed on one of the surfaces of base layer 10 in depressions 12, on the plateaus 14 and on the sloping walls 16. When an outer fabric layer, such as a broadcloth or a variety of batiste, is bonded to the construction of FIG. 2, the bonding is primarily by the adhesive dots. Due to non-planar orientation or contours of the applied adhesive dots, the end product can acquire a contoured surface pattern resulting in a non-smooth, streaky appearance. When washed, the bonded structure loosens and a puffiness can develop giving the streaks an even more pronounced streaky appearance. The heavier the base material, the more severe the problem after washing.

Figure 3:
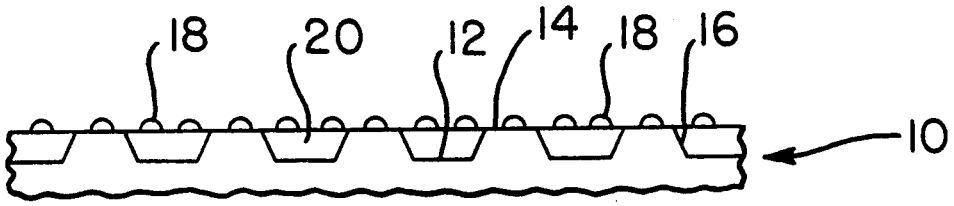
FIG. 3 shows an interlining of the invention.

FIG. 3 shows an interlining of the invention. A fleece containing adhesive fibers 20 is deposited on to the base material of FIG. 1 in an amount of 6 to 40 gm/m$^2$ and preferably 10 to 25 g/m$^2$. Preferably the weight of fleece layer 20, without the adhesive dots, is less than that of the base material, i.e., about $\frac{1}{3}$ of that of the base layer. The amount of the fleece material is such that it at least covers the depressions 12 after bonding so as to provide a uniform surface. Preferably, the fleece is deposited so as to form a layer which covers the depressions (pits) and the plateaus.

Generally speaking, the fleece layer 20 can be of polyester fibers, polyolefin fibers (polyethylene, polypropylene) and mixtures thereof. More specifically, fleece layer 20 can be:

a) 100% polyester, preferably
b) polyester and 30 to 70 wt.-% polyethylene as a homofil fiber but can be up to 100% polyethylene;
c) polyester and polyester/polyethylene bicomponent fibers, up to 100% bicomponent fiber and preferably 70 to 100 wt.-% of bicomponent fibers;
d) polyester and polypropylene homofil fiber, up to 100% polypropylene homofil fiber, preferably 30% wt.-% polyester and 70 wt.-% polypropylene homofil fibers;
e) polyester and polyester/polypropylene bicomponent fibers, up to 100% bicomponent fiber and preferably 70 to 100 wt.-% of bicomponent fibers;
f) polyester together with copolyester homofil fibers, with 100% copolyester homofil fiber and preferably 30 wt.-% polyester and 70 wt.-% of the copolyester homofil fiber; and
g) polyester w/polyester copolyester bicomponent fiber, up to 100% bicomponent fiber and preferably 70 to 100 wt.-% of bicomponent fiber.

The fleece layer can be deposited on the base material by numerous techniques such as carding, air-laying, melt blowing, spun bonding and wet laying. A layer can also be deposited on the base material as an extruded porous film.

In a highly preferred embodiment, the polyester is PET. When a copolyester is used it is preferred to contain PET and PBT (blocked).

After the fleece layer 20 is applied onto the base material 10, the base material and fleece layer are subjected to heat and pressure, or other means of bonding, to form a bonded structure. The oven temperature is above the fleece fiber melting point but the calender temperature is below its melting point. Generally the oven temperature is in the range of 100° C. to 230° C. while the calender temperature is about 80° C. to 220° C. A pressure range of 10 to 80 kiloponds/cm is useful.

Subsequent to the bonding of the fleece to the base material, the adhesive is applied in a known manner such as by printing, powder point application, powdering or as an adhesive web. The adhesive is oriented in a planar arrangement so as to show little or none of the preexisting contours of the base material. At least some of the adhesive dots, and preferably a majority of the dots, are separated from the base material by the fleece.

Figure 4:
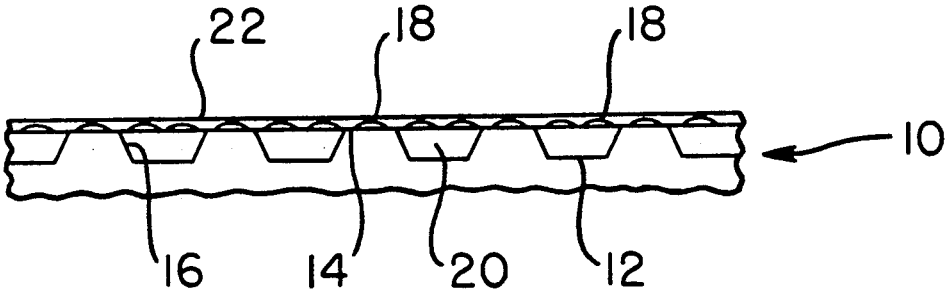
FIG. 4 shows an interlining of the invention fused to an outer fabric.

FIG. 4 shows the interlining of FIG. 3 fused to an outer fabric 22 which may be a broadcloth or the like. The outer fabric 22 is fused to the interlining primarily through the adhesive dots 18 and, as shown in the Figure has a substantially even or smooth appearance not following the contour of the textured or contoured nonwoven.

EXAMPLE 1

A point-bonded nonwoven base material of 52 g/m$^2$ is provided. A fleece layer of 14 g/m$^2$ of 100% PET/PE S/C [sheath/core] bicomponent fibers is applied on top of the base material by carding. The base material and fleece layer are heated in a through air oven to about 140° C. and then press heated through a calender-roller at about 110° C. at about 40 kiloponds/cm. Adhesive dots of 23 g/m$^2$ of HDPE are then applied by paste printing to the top surface of the fleece layer.

The interlining has a pattern of adhesive dots on the fleece layer which is substantially planar. The majority of the dots were not in contact with the base material.

EXAMPLE 2

A point-bonded nonwoven base material of 45 g/m$^2$ of 100% PED is provided. A fleece layer of 16 g/m$^2$ of 50% PET and 50% polypropylene fibers is applied on top of the base material by carding. The base material and fleece layer are heated in a through air oven to about 160° C. and then press heated through a calender-roller at about 125° C. at about 40 kiloponds/cm. Adhesive dots of 20 g/m$^2$ of HDPE are then applied by paste printing to the top surface of the fleece layer.

The adhesive dots on the fleece layer were substantially planar. The majority of the dots are not in contact with the base material.

EXAMPLE 3

A point-bonded nonwoven base material of 35 g/m$^2$ of 90% PET and 10% Nylon is provided. A fleece layer of 14 g/m$^2$ of 60% PET and 40% polyethylene homofil fibers is applied on top of the base material by carding. The base material and fleece layer are heated in a through air oven to about 143° C. and then press heated through a calender-roller at about 110° C. at about 40 kiloponds/cm. Adhesive dots of 18 g/m$^2$ of HDPE are then applied by a powder point applicator to the top surface of the fleece layer.

The adhesive dots on the fleece layer were substantially planar. The majority of the dots were not in contact with the base material.

EXAMPLE 4

A point-bonded nonwoven base material of 52 g/m$^2$ of 100% PET is provided. A fleece layer of 18 g/m$^2$ of 100% PET/Co-PES bicomponent fibers is applied on top of the base material by carding. The base material and fleece layer are heated in a through air oven to about 200° C. and then pressed between heated calender rollers at about 180° C. at about 60 kiloponds/cm. Adhesive dots of 27 g/m$^2$ of HDPE are then applied by paste printing to the top surface of the fleece layer.

The adhesive dots on the fleece layer were substantially planar. The majority of the dots were not in contact with the base material.

It will be understood that the specification and examples are illustrative but not limitative of the present invention and that other embodiments within the spirit and scope of the invention will suggest themselves to those skilled in the art.

We claim:

1. A shirt interlining comprising:

a base material having a contoured or textured surface and bonded thereon an intermediate layer comprising a fleece of fibers, said fleece of fibers or a porous film, said intermediate layer having an upper surface on which there is disposed a plurality of heat activatable adhesive means, said adhesive means being substantially in a single planar arrangement and at least some of which are separated from said base material by the intermediate layer.

2. The shirt interlining of claim 1 wherein the base material is a point bonded nonwoven fabric.

3. The shirt interlining of claim 1 wherein said base material is of polyester.

4. The shirt interlining of claim 1 wherein said base material is polyester and contains up to 90 wt.-% of one or more co-fibers selected from the group consisting of rayon, Nylon 6, Nylon 6,6 and cotton.

5. The shirt interlining of claim 3 wherein the base material includes up to 90 wt.-% of a copolyester either as a homofil or heterofil.

6. The shirt interlining of claim 1 wherein the base material is PET.

7. The shirt interlining of claim 1 wherein the base material contains a blend of PET and PBT.

8. The shirt interlining of claim 1 wherein the base material has a weight of at least 25 g/m$^2$.

9. The shirt interlining of claim 1 wherein the fleece of fibers has a weight of 6 to 40 g/m$^2$ and preferably 10 to 25 g/m$^2$.

10. The shirt interlining of claim 1 wherein the weight of the fleece, without the adhesive means is less than that of the base material.

11. The shirt interlining of claim 1 wherein the fleece is selected from the group consisting of polyester fiber, polyethylene fiber, polyester/polyethylene bicomponent fiber, polypropylene fiber, polyester/polypropylene bicomponent fiber, copolyester fiber, polyester/copolyester bicomponent fiber, and mixtures of polyester fiber and polyethylene, polyester/polyethylene bicomponent, polypropylene, polyester/polypropylene bicomponent, copolyester, or polyester/copolyester bicomponent fiber.

12. The shirt interlining of claim 1 wherein the fleece comprises PET fiber.

13. The shirt interlining of claim 1 wherein the fleece is a mixture of polyester fiber and 30 to 70 wt.-% of polyolefin fiber as a homofil fiber.

14. The shirt interlining of claim 1 wherein the fleece is a mixture of polyester fiber and 30 to 70 wt.-% of polyolefin bicomponent fiber.

15. The shirt interlining of claim 1 wherein the fleece comprises a copolyester homofil fiber.

16. The shirt interlining of claim 15 wherein the fleece is a mixture of 70 wt.-% of copolyester homofil fiber and polyester fiber.

17. The shirt interlining of claim 1 wherein the fleece comprises polyester with copolyester bicomponent fiber.

18. The shirt interlining of claim 17 wherein the fleece is a mixture of polyester and at least 70 wt.-% of bicomponent fiber.

19. A textile product comprising: an outer fabric fused to the interlining of claim 1 through the plurality of heat activatable adhesive means.

20. The textile product of claim 19 wherein the outer fabric is a broadcloth.

21. The textile product of claim wherein the outer fabric is a batiste.

22. A method of making a garment interlining comprising:

providing a bonded base material having a contoured or textured surface;

depositing an intermediate layer comprising a fleece of fibers or a porous film on said surface;

bonding the intermediate layer to the base material; and applying a plurality of heat activatable adhesive means to the intermediate layer.

23. The method of claim 22 wherein the base material is a point bonded nonwoven fabric.

24. The method of claim 26 wherein the intermediate layer is a fleece containing adhesive fibers.

25. The method of claim 22 wherein said base material is of polyester.

26. The method of claim 22 wherein said base material is polyester and contains up to 90 wt.-% of one or more co-fibers selected from the group consisting of rayon, Nylon 6, Nylon 6,6 and cotton.

27. The method of claim 22 wherein the base material includes up to 90 wt.-% of a copolyester either as a homofil or heterofil.

28. The method of claim 22 wherein the base material is PET.

29. The method of claim 22 wherein the base material contains a blend of PET and PBT.

30. The method of claim 22 wherein the base material has a weight of at least 25 g/m$^2$.

31. The method of claim 22 wherein the fleece of fibers has a wight of 6 to 40 g/m$^2$ and preferably 10 to 25 g/m$^2$.

32. The method of claim 22 wherein the weight of the fleece, without the adhesive means is less than that of the base material.

33. The method of claim 22 wherein the fleece is deposited on the base material by a carding, air-laying, spun bonding, wet laying or melt blowing process or by a combination thereof.

34. The method of claim 22 wherein the intermediate layer is deposited on the base material as an extruded porous film.

35. The method of claim 22 wherein the bonding of the fleece to the base material includes the application of heat and pressure.

36. The method of claim 22 wherein the fleece is selected from the group consisting of polyester fiber, polyethylene fiber, polyester/polyethylene bicomponent fiber, polypropylene fiber, polyester/polypropylene bicomponent fiber, copolyester fiber, polyester/copolyester bicomponent fiber, and mixtures of polyester fiber and polyethylene, polyester/polyethylene bicomponent, polypropylene, polyester/polypropylene bicomponent copolyester, or polyester/copolyester bicomponent fiber.

37. The method of claim 22 wherein the fleece comprises PET fiber.

38. The method of claim 22 wherein the fleece is a mixture of polyester fibers and 30 to 70 wt.-% of polyolefin fiber as a homofil fiber.

39. The method of claim 22 wherein the fleece is a mixture of polyester fiber and 30 to 70 wt.-% of polyolefin bicomponent fiber.

40. The method of claim 22 wherein the fleece comprises a copolyester homofil fiber.

41. The method of claim 40 wherein the fleece is a mixture of 70 wt.-% of copolyester homofil fiber and polyester fiber.

42. The method of claim 22 wherein the fleece comprises polyester with copolyester bicomponent fiber.

43. The method of claim 42 wherein the fleece is a mixture of polyester and at least 70 wt.-% of bicomponent fiber.

* * * * *

UNITED STATES PATENT AND TRADEMARK OFFICE

CERTIFICATE OF CORRECTION

PATENT NO. : 5,063,101

DATED : November 5, 1991

INVENTOR(S) : Peter S. Grynaeus et al

It is certified that error appears in the above-identified patent and that said Letters Patent is hereby corrected as shown below:

Column 4, line 37, "PED" should read --PET--.

Column 6, line 15 (claim 21), "of claim wherein" should read --of claim 19 wherein--.

Column 6, line 29 (claim 24), "26" should read --22--.

Signed and Sealed this

First Day of June, 1993

*Attest:*

Michael K. Kirk

MICHAEL K. KIRK

*Attesting Officer*

*Acting Commissioner of Patents and Trademarks*